United States Patent [19]

Piras et al.

[11] Patent Number: 4,844,425

[45] Date of Patent: Jul. 4, 1989

[54] APPARATUS FOR THE ON-LINE TREATMENT OF DEGASSING AND FILTRATION OF ALUMINUM AND ITS ALLOYS

[75] Inventors: Leonardo Piras; Giuseppe Lazzaro, both of Portoscuso, Italy

[73] Assignee: Alumina S.p.A., Cagliari, Italy

[21] Appl. No.: 182,411

[22] Filed: Apr. 18, 1988

[30] Foreign Application Priority Data

May 19, 1987 [IT] Italy ..... 20578 A/87

[51] Int. Cl.[4] ..... C22B 9/02; C22B 9/05

[52] U.S. Cl. ..... 266/215; 266/220; 266/229; 266/233

[58] Field of Search ..... 266/215, 220, 229, 233; 75/68 R

[56] References Cited

U.S. PATENT DOCUMENTS

| | | | |
|---|---|---|---|
| 3,904,180 | 9/1975 | Bass et al. | 266/220 |
| 3,917,242 | 11/1975 | Bass et al. | 266/220 |
| 4,092,153 | 5/1978 | Yarwood et al. | 75/68 R |
| 4,589,634 | 5/1986 | Bleickert | 266/215 |

*Primary Examiner*—Robert McDowell

*Attorney, Agent, or Firm*—Collard, Roe & Galgano

[57] ABSTRACT

Apparatus for on-line degassing and filtering aluminum and its alloys, constituted by a thermally insulated container body, provided with a removable lid (2) incorporating heating means (7) for heating the metal to be processed, said container body being internally subdivided, by means of a vertical partitioning wall (11) into two chambers communicating with each other only near the bottom of the container, wherein in one of said two chambers, provided with an inlet for the liquid metal to be processed, injection means (13, 14) are provided, for injecting inert, and/or active gases, which are so located as to perform a degassing in countercurrent relatively to the entering metal stream, while at the bottom of the second chamber at least a substantially horizontal plate, or wall (12) is provided, made of a porous material, such as ceramic, graphite, or the like, which is positioned spaced apart from the bottom of the container, such to allow the metal, coming from the first chamber, to flow upwards, and pass through said porous plate, with a rising movement of laminar type.

4 Claims, 1 Drawing Sheet

APPARATUS FOR THE ON-LINE TREATMENT OF DEGASSING AND FILTRATION OF ALUMINUM AND ITS ALLOYS

SUMMARY OF THE INVENTION

The object of the present invention is to provide an apparatus for the combined, on-line treatment of degassing and filtration of liquid aluminum, and/or its alloys.

It is known that the processes of degassing and purification of a liquid metal have the purpose of removing the hydrogen dissolved inside the liquid mass, and also some solid impurities, such as, e.g., oxides and salts, various slagging substances, sodium fluoride, aluminum fluoride and still other fluorides, whose presence in suspension is also favoured by the presence of hydrogen: the degassing is generally carried out by injecting nitrogen free from oxygen, or argon, or another inert gas, which act by entraining, and by mixing the liquid metal.

Also known are various processes for purifying liquid aluminum by means of the injection of active gases, such as chlorine, or other gases developing chlorine in situ, such as, e.g., chlorofluorocarbons, to the end of removing the alkali metals coming from the electrolysis of cryolite baths; in fact, chlorine combines with sodium forming sodium chloride which, by being a solid, goes to end in the slag, dragged to the surface by the injected inert gas.

In particular, chlorofluorocarbons act as reactants and also act by entraining the suspended particles which, when come to the surface of the liquid metal, are englobed by the scorifiers and are skimmed from the same surface.

In order to obtain metal and light alloys endowed with particular characteristics of purity and structural homogeneousness, even the smallest solid particles which remain equally dispersed in suspension, have to be removed. To that end, according to some techniques known from the prior art, chlorine is delivered, through graphite rotors, which act as true stirrers; they, by revolving inside the liquid metal, keep it stirred, and thus facilitate the removal of the solid particles, which rise to the metal surface under the thrust applied by the gas escaping from the rotor. In practice, this technique suffers from the serious drawback that it uses, inside a high-temperature mass, moving parts, which show a rapid decay, and which result difficult to be managed.

Also processes for liquid aluminum filtering are known, which use substantially spherical bodies of tabular alumina, which allow the impurities to be adsorbed by the same spherical bodies, on their surface; but the spherical bodies get rapidly clogged, losing their adsorbent characteristics, and hence require expensive operations of cleaning and reclamation.

More recently, processes of filtration of liquid metal have been proposed, according to which the liquid metal is filtered through porous septa, provided inside a chamber, with the liquid metal being fed from the top, and the filtered metal being discharged under the porous septum.

These porous septa are generally made of graphite, ceramic, and also of various types of agglomerates; in practice, they suffer from the serious drawback that they get clogged after a short operating time, in that the impurities, pressed against the filter by the pressure of the metal, and by the same impurities which have been previously collected on the surface of the filter, tend to clog it, also in an irreversible way; the filter must be therefore removed, after the apparatus being preliminarily emptied, then cleaned, if possible, and then reassembled, or replaced, with evident financial and practical burdens.

Therefore, a purpose of the present invention is to provide an apparatus for the on-line degassing and filtration of liquid aluminum, and/or of its alloys, which is capable of overcoming the drawbacks and the limitations which affect the apparatuses and processes known from the prior art, and, above all, such as to result highly efficacious and reliable in the treatment of the metal.

Another purpose of the invention is to provide an apparatus of the above specified type, having such a structure as to result cheap, as relates to the installation costs and the operating costs, and easy to be operated and regulated.

These and still other purposes, as they may be better evidenced by the following disclosure, are achieved by an apparatus for on-line degassing and filtering liquid metals, in particular, aluminum and its alloys, by means of the use of inert and/or active gases and of filtering porous plates or septa, which apparatus is constituted, according to the present invention, by a substantially parallelepipedon container body, provided with a removable lid, integrally thermally insulated and incorporating heating means for heating the metal to be processed, said container body being internally subdivided, by means of a vertical partitioning wall, into two chambers communicating with each other only in the nearby of the bottom of the container, wherein in one of said two chambers, provided with an inlet port for the liquid metal to be processed, injection means are provided, for injecting inert, and/or active gases, which are so located as to perform a degassing in countercurrent relatively to the entering metal stream, whilst at the bottom of the second chamber at least a substantially horizontal plate, or septum is provided, of a porous material, such as ceramic, graphite, a ceramic agglomerate, or the like, which is positioned spaced apart from the bottom of the container, such to allow the metal, coming from the first chamber, to flow upwards, and pass through said porous plate, with a rising movement of laminar type, and allow the filtered metal to reach the discharge port.

More particularly, said injection means for injecting inert or active gases are constituted by pipes, or the like, which are anchored, in a vertical position, to said removable lid, and are provided, in their bottom portion, with blocks, or cylinders, or cones of a porous material, the length of said injection pipes being such as to position the porous cylinders in the nearby of the bottom of the container, such to make it possible the injected gas to be diffused, and uniformly distributed throughout the mass of molten metal, without causing vortexes, or an irregular mixing of the same metal.

These and other objects and advantages of the present invention will become apparent from the following description of the accompanying drawing, which discloses one embodiment of the invention. It is to be understood that the drawing is to be used for purposes of illustration only, and not as a definition of the invention.

BRIEF DESCRIPTION OF THE DRAWING

Further advantages and details can be gleaned from the drawing wherein similar reference numerals denote similar elements throughout the several views.

DESCRIPTION OF THE PREFERRED EMBODIMENT

Figure 2:
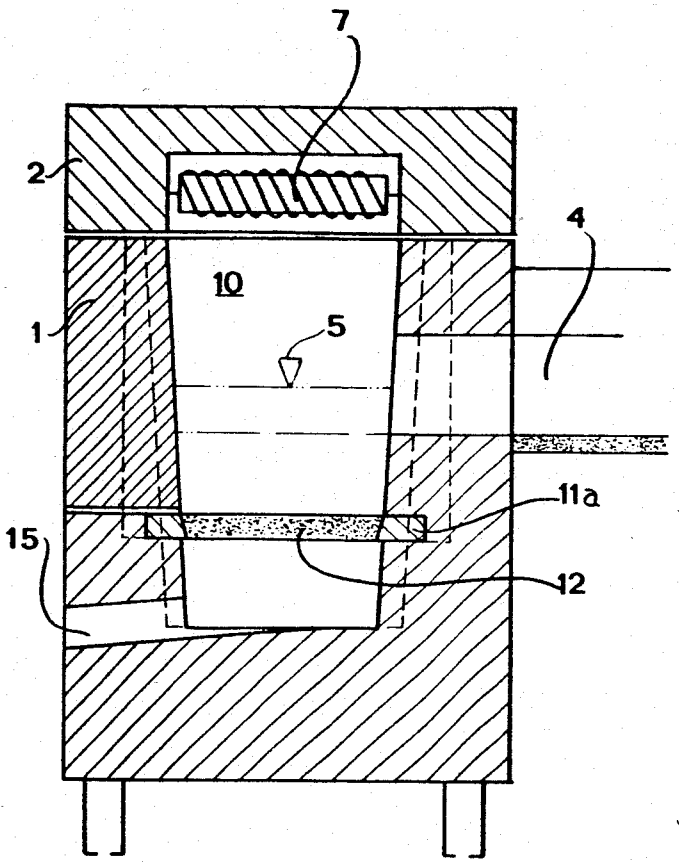
FIG. 2 shows a vertical sectional view of the apparatus of FIG. 1, taken along the broken line A—A.

Referring to such Figures, the apparatus of the present invention is constituted by a container body 1, having a substantially parallelepipedon shape, with thermally insulated walls, which is open in the top, and can be tightly sealed by a flat lid 2, which is also coated with a thermally insulating material. Through a side wall of the container 1, an inlet port 3 for molten metal feeding, and, in a spaced apart position, an outlet port 4 for filtered metal discharging, are provided; both the inlet port 3 and the outlet port 4 are located at substantially the same height from the bottom of the container 1, and are so dimensioned, that the level 5 of the liquid metal substantially corresponds to the middle axis 6 of the inlet port 3. Inside the lid 2, a plurality of electrical resistors 7 are installed, to heat the liquid metal during the degassing and filtration treatment. Atop the vertical walls of the container 1, vents 8 are provided (FIG. 1), to allow the treatment gases to escape, as it is better clarified in the following. The interior of the container 1 is then subdivided into two chambers 9 and 10, different in volume, by a vertical, substantially "L"-shaped partitioning wall 11, which has such dimensions, as to extend up to a certain distance from the bottom of the container; it then continues with its horizontal portion 11a, up to come into contact with the inner wall of the container. Such partitioning wall bounds the filtration chamber 10 communicating with the outlet port 4, whilst the chamber 9, constituting the degassing chamber, remains in communication with the inlet port 3. On the horizontal portion 11a of the partitioning wall, a plate 12 of a porous material, such as ceramic, graphite, or various conglomerates, is installed, to act as the filtering means for filtering the liquid metal fed into the chamber 9.

Figure 1:
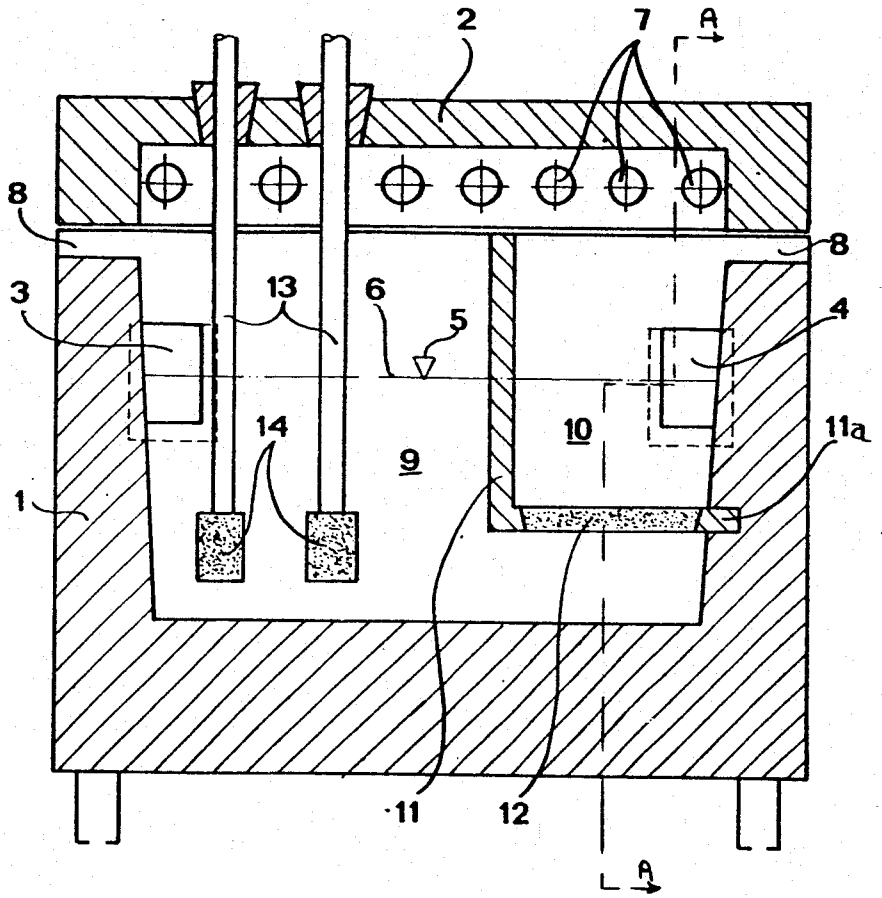
FIG. 1 schematically shows a vertical sectional view, taken along the middle thereof, of an on-line degassing and filtering apparatus accomplished according to the invention.

Inside the chamber 9, injection pipes are furthermore installed, to inject inert and/or active gases, such as nitrogen, argon, chlorine and other gases, such pipes being indicated by the reference numeral 13 in FIG. 1; they are anchored to the lid; and extend above it. Said pipes show, at their opposite end, a cone, or a cylinder, 14, of a porous material, such as coal. Furthermore, the arrangement of the pipes 13 is such that the cylinders 14 are maintained in the nearby of the bottom of the container, in such a way that the gas, evenly and homogeneously diffused and distributed by the porous cylinders, may concern the whole volume of liquid metal contained inside the chamber 9, without causing vortexes or any irregular mixing, which would endanger the subsequent operations of filtration. The particular position of the gas injection pipes makes it possible to perform a degassing in countercurrent relatively to the metal flow. Therefore, by providing two chambers, so arranged as to communicate with each other according to the principle of the communicating vessels, the outgassing with filtration is carried out on-line, and the large dimensions of the filtering chamber 10 cause the rising motion of the metal, which flows through the filtering plate 12, to be of substantially laminar type: furthermore, in as much as the filtration takes place from down upwards, through the plate 12, any impurities and solid particles, entrained by the metal, already degassed in the previous chamber 9, are forced to stop against the lower surface of the filtering plate, and, hence, to fall down to the bottom of the container, from which they are periodically removed through a drain channel 15 (FIG. 2).

The ratio between the volumes of the two chambers 9 and 10 and the surface of the porous septum 12 are such to allow, as already said, a laminar and slow flow of the metal to establish from down upwards, which does not cause any pressures to be applied by the impurities to the porous septum, and, above all, which does not hinder the falling down, and settling of the particles of impurities onto the bottom of the parallelepipedon container, according to the invention. The dimensions of the chambers, as well as of the inlet and outlet ports are such to maintain within pre-established limits the difference in liquid level which is established between the two chambers by the effect of the resistance offered by the filtering plate, such resistance being a function of the degree of clogging of the same plate; if the difference in liquid level occurring during the operation exceeds the pre-established level, the liquid metal overflows from one chamber into the other chamber, through an opening (not shown in the Figures) provided through the partitioning wall 11.

Finally, in order to secure the metal to outflow even in case of a complete clogging of the filtering plate, outside the same filtering plate, a discharge channel, not shown in the Figures, is provided.

The above disclosed apparatus, thanks to its structural simpleness, to the absence of moving parts, and to the realization of the filtration from down upwards through a filtering plate very simple in structure, made it possible in practice a high efficacy to be obtained in practicing the treatment of liquid aluminum, with a high efficiency, low operating costs, and a long useful life of the filtering plate or septum.

Finally, it is obvious that to the invention, as above discussed according to a preferred accomplishment way, in practice modifications and variants can be supplied, which are structurally and functionally equivalent, without going out of the purview of protection of the same invention.

While one embodiment and example of the present invention has been illustrated and described, it is obvious that many changes and modifications may be made thereunto, without departing from the spirit and scope of the invention.

What is claimed is:

1. An apparatus for processing molten aluminum and its alloys including on-line degassing by means of fluxing gas and the filtering of the molten aluminum and its alloys by means of a porous plate, comprising:

a hollow container body having an open top;

a removable, thermally insulated lid for covering said container top and incorporating a heating means for heating the metal to be processed;

a partitioning wall dividing said container body into a first and second chamber;

an inlet port in a wall of said container body for introducing the molten metal to be processed into said first chamber;

a discharge port in the bottom of said second chamber for the discharge of the processed metal, said partitioning wall being spaced from a bottom of said container body to define a passageway communicating between said first and second chambers;

means for introducing a fluxing gas into said first chamber for degassing the molten aluminum and its alloys; and, a generally horizontal filtering plate made of an inert porous material located in a portion of said partitioning wall forming a bottom of said second chamber so that the molten aluminum and its alloys flows downwardly from said first chamber into said passageway and then flows upwardly through said porous plate in a calm, non-turbulent rising movement of laminar flow into said second chamber and through said discharge port.

2. The apparatus according to claim 1, wherein said bottom of said container body under said filtering plate includes a discharge channel for the removal of the slag filtered by the filtering plate and settling on said bottom of said container body.

3. Apparatus according to claim 1, wherein said injection means for injecting inert and/or active gases comprise downwardly extending pipes, supported by said removable lid, and provided, at their bottom ends with a, gas distribution element comprised of a porous material.

4. Apparatus according to claim 1, wherein said heating means, for heating the metal under treatment, are constituted by electrical resistors which are installed on an inner surface of said removable lid of said container body.

* * * * *

UNITED STATES PATENT AND TRADEMARK OFFICE

CERTIFICATE OF CORRECTION

PATENT NO. : 4,844,425

DATED : JULY 4, 1989

INVENTOR(S) : Leonardo PIRAS AND Giuseppe LAZZARO

It is certified that error appears in the above-identified patent and that said Letters Patent is hereby corrected as shown below:

Cover page, column 1, item [73] line 1, after "Assignee:" delete "Alumina" and substitute therefor —Aluminia—.

Signed and Sealed this

Ninth Day of October, 1990

*Attest:*

HARRY F. MANBECK, JR.

*Attesting Officer*

*Commissioner of Patents and Trademarks*